US011497324B2

(12) United States Patent
Olesen et al.

(10) Patent No.: US 11,497,324 B2
(45) **Date of Patent: *Nov. 15, 2022**

(54) METHOD FOR MOUNTING A COVER WITH SLIDABLE LIDS ONTO A REFRIGERATED MERCHANDISING STORAGE UNIT

(71) Applicant: Rehau-Behr A/S, Hadsten (DK)

(72) Inventors: Søren Olesen, Hadsten (DK); Jesper Grauballe Rasmussen, Viby J (DK)

(73) Assignee: REHAU-BEHR A/S, Hadsten (DK)

( * ) Notice: Subject to any disclaimer, the term of this patent is extended or adjusted under 35 U.S.C. 154(b) by 0 days.

This patent is subject to a terminal disclaimer.

(21) Appl. No.: 17/259,365

(22) PCT Filed: Jul. 4, 2019

(86) PCT No.: PCT/DK2019/050220
§ 371 (c)(1),
(2) Date: Jan. 11, 2021

(87) PCT Pub. No.: WO2020/011324
PCT Pub. Date: Jan. 16, 2020

(65) Prior Publication Data

US 2021/0298491 A1 Sep. 30, 2021

(30) Foreign Application Priority Data

Jul. 12, 2018 (DK) ..... 201870483

(51) Int. Cl.
*A47F 3/04* (2006.01)
*F25D 23/02* (2006.01)

(52) U.S. Cl.
CPC ..... *A47F 3/043* (2013.01); *F25D 23/021* (2013.01); *F25D 23/026* (2013.01)

(58) Field of Classification Search
CPC ..... A47F 3/04; A47F 3/043; A47F 3/0434; F25D 23/02; F25D 23/021; F25D 23/026
See application file for complete search history.

(56) References Cited

U.S. PATENT DOCUMENTS 2,793,925 A 5/1957 Rosen
8,162,413 B2 * 4/2012 Behr ..... A47F 3/0434 312/116

(Continued)

FOREIGN PATENT DOCUMENTS

DE 19717896 A1 * 10/1998 ..... A47F 3/043
DE 102005003119 A1 * 7/2006 ..... A47F 3/0434

(Continued)

OTHER PUBLICATIONS

Translated Description JP2009017965A, 6 pages (Year: 2009).*

(Continued)

*Primary Examiner* — Andrew M Roersma
(74) *Attorney, Agent, or Firm* — Knobbe, Martens, Olson & Bear, LLP

(57) ABSTRACT

A method for mounting a cover with a plurality of slidable lids (7) onto a storage compartment (2) of a refrigerated merchandising storage unit (1) is disclosed, comprising the steps of providing two or more cover cassettes (6), each comprising one or more slidable lids (7) and mounting the two or more cover cassettes (6) on top of the storage compartment (2). Furthermore, a refrigerated merchandising storage unit (1), a cover of which is mounted using such a method, is disclosed.

15 Claims, 10 Drawing Sheets

(56) References Cited

U.S. PATENT DOCUMENTS

Figure 1A:
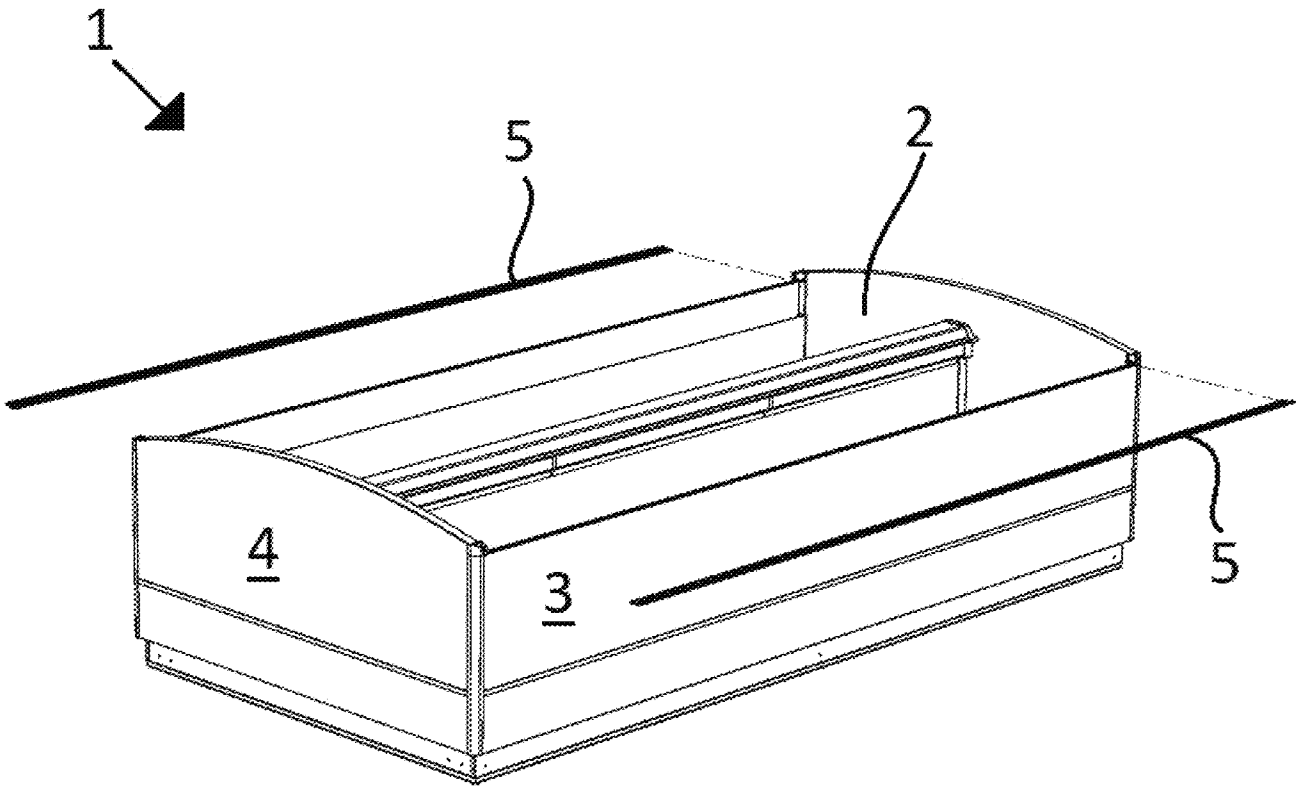

| | | | | |
|---|---|---|---|---|
| RE45,742 | E * | 10/2015 | Behr | A47F 3/0434 |
| 9,829,239 | B2 * | 11/2017 | Buehning | A47F 3/043 |
| 10,918,225 | B2 * | 2/2021 | Olesen | F25D 23/021 |
| 2002/0190619 | A1 | 12/2002 | Brauer | |
| 2009/0224544 | A1 | 9/2009 | Bartlett | |
| 2014/0109607 | A1 | 4/2014 | Buehning et al. | |
| 2016/0348956 | A1 * | 12/2016 | Toschek | B65D 25/04 |

FOREIGN PATENT DOCUMENTS

| | | | | |
|---|---|---|---|---|
| DE | 102015006623 | A1 * | 9/2016 | A47F 3/043 |
| EP | 1692978 | A1 * | 8/2006 | A47F 3/0434 |
| EP | 2645025 | A2 * | 10/2013 | F25D 23/021 |
| EP | 2808629 | A1 * | 12/2014 | F25D 23/026 |
| JP | 2009-017965 | A | 1/2009 | |
| WO | 97/19621 | A1 | 6/1997 | |
| WO | 2018/069004 | A1 | 4/2018 | |

OTHER PUBLICATIONS

International Preliminary Report on Patentability for International Application No. PCT/DK2019/050220, dated Nov. 20, 2020 in 12 pages.

* cited by examiner

METHOD FOR MOUNTING A COVER WITH SLIDABLE LIDS ONTO A REFRIGERATED MERCHANDISING STORAGE UNIT

CROSS-REFERENCE TO RELATED APPLICATIONS

This application is the U.S. National Phase under 35. U.S.C. § 371 of International Application PCT/DK2019/050220, filed Jul. 4, 2019, which claims priority to Danish Patent Application No. PA201870483, filed Jul. 12, 2018. The disclosure of which including the specification, the drawings, and the claims is hereby incorporated by reference in its entirety.

FIELD OF THE INVENTION

The present invention relates to a method for mounting a cover with slidable lids onto a refrigerated merchandising storage unit, such as a refrigerator or a freezer with a rectangular top opening, in such a way that the lids can be moved, preferably sideways or back and forth, for creating an opening into a cooled compartment.

BACKGROUND OF THE INVENTION

Refrigerated display and storage units used in supermarkets and the like for displaying food, typically have a top opening covered with transparent lids allowing the grocery of choice to be easily located by the customers. The lids may be displaced in different ways for making the displayed food accessible for the customer.

It is known to mount the lids in such a way that the compartment is accessible by displacing a lid like a door, for instance by attached one side of the lid to the storage unit using hinges. Other methods include the use of one or more slidable lids. These can be displaced either sideways or back and forth, sliding underneath or on top of a neighbouring lid or a stationary cover section of the compartment.

In general, such transparent lids are typically mounted in a frame, which is in turn slidably mounted in tracks. Examples hereof are shown, for instance, from US 2002/0190619 and US 2009/0224544. The lids can, however, also be mounted directly in the tracks resting slidably on the surface of the track. In order to prevent dislocation of a lid from one or more tracks, the rails, in which the tracks are formed, can be pushed towards each other, so that two opposite edges of the lid are enclosed by the rails. In this case, the rails or at least a part thereof need to be moved before and after replacement of a lid. An example hereof is shown in WO 97/19621.

If the lids are not properly retained within the tracks when mounted, there is a risk of separation of the lids from the tracks when in use. If the lids and the tracks can disconnect, the lid may fall into the storage unit, which is very inconvenient.

BRIEF DESCRIPTION OF THE INVENTION

It is an object of the present invention is to provide a method for mounting a cover with slidable lids onto a refrigerated merchandising storage unit, which method enables an easy installation and replacement of the cover through a simple manoeuvre requiring only a minimum amount of labour.

Furthermore, it is a further object of the invention to provide a method for mounting the cover in such a way that the lids are slidably retained within tracks, thus eliminating the risk of separation of the lids from the tracks.

A particular cover is disclosed in international application WO 2018/069004 A1, which comprises a retainer arrangement with a latch and a protrusion provided for retaining the lids in the tracks.

The present invention relates to a method for mounting a cover with a plurality of slidable lids onto a storage compartment of a refrigerated merchandising storage unit for display and sale of foodstuff or the like, which storage compartment has a substantially rectangular top opening, wherein the method comprises the steps of:

- providing two or more cover cassettes, each comprising one or more slidable lids, two cross profiles arranged along two opposite sides of the cover cassette, respectively, and two base profiles arranged along two opposite ends of the cover cassette, respectively, perpendicularly to the cross profiles, each cross profile or each base profile comprising one or more elongated and generally U-shaped tracks, each of which is arranged for receiving an edge of a slidable lid in such a way that the slidable lid can be slid along a longitudinal direction of the track
- mounting the two or more cover cassettes on top of the storage compartment in such a way that two opposite ends of each cover cassette rest upon two upwards-facing edges of the storage compartment, respectively, and in such a way that the two or more cover cassettes together form a cover of the refrigerated merchandising storage unit.

Mounting the cover using such a method is advantageous, among other reasons, because the cover cassettes can be assembled before being mounted under optimized conditions in a factory. This significantly increases the efficiency or the mounting procedure and reduces the cost and time consumption related to the mounting of the cover onto the storage compartment.

In an embodiment of the invention, the method comprises, before the step of mounting the two or more cover cassettes on top of the storage compartment, a step of mounting along each of the two upwards-facing edges of the storage compartment, onto which the two or more cover cassettes are to rest, a spacer profile, which is arranged to be able to engage releasably with the base profiles of the two or more cover cassettes. In alternative embodiments, the base profiles of the cover cassettes are fastened, e.g. glued, directly onto the upward-facing edges of the storage compartment.

Such a construction enables for a simple and fast mounting of the cover cassettes onto the storage compartment and for a simple and fast replacement of two or more cover cassettes, should it be necessary.

In an embodiment of the invention, the method comprises, after the step of mounting the two or more cover cassettes on top of the storage compartment, a step of mounting along each the two upwards-facing edges of the storage compartment, onto which the two or more cover cassettes rest, a cover profile, which is arranged to be able to engage releasably with the base profiles of the two or more cover cassettes and, if present, with the spacer profiles.

The use of a cover profile is a simple and easy way of ensuring an aesthetically satisfying design of the refrigerated merchandising storage unit after the mounting of the cover.

In an embodiment of the invention, the releasable engagements between the base profiles of the two or more cover cassettes and the spacer profiles and/or the cover profiles are designed as click-together assemblies.

In an embodiment of the invention, the base profiles of the two or more cover cassettes rest upon the long sides of the storage compartment.

In an embodiment of the invention, the two or more slidable lids of each cover cassette are arranged to be slidable in a direction perpendicular to the longitudinal direction of the storage compartment.

In an embodiment of the invention, each of the two or more cover cassettes comprises two slidable lids being arranged to be slid, one above the other, away from the long sides of the storage compartment, respectively, towards the centre thereof for giving access to the interior thereof.

In an embodiment of the invention, each of the two or more cover cassettes further comprises a fixed lid arranged above the two slidable lids in a central part of the cover cassette.

In an embodiment of the invention, the fixed lid is arranged on top of the cross profiles of the cover cassette.

In an embodiment of the invention, the one or more slidable lids of a cover cassette are arranged to be able to slide in a direction parallel to the longitudinal direction of the storage compartment.

In an embodiment of the invention, the two or more cover cassettes and the cross profiles thereof are curved in a direction perpendicular to the longitudinal direction of the storage compartment.

In an embodiment of the invention, the dimension in one direction of the two or more cover cassettes is 0.94 meter or 1.25 meter.

This means that two, three or four of such cover cassettes together fit the opening of the storage compartment of refrigerated merchandising storage units with a standard length of e.g. 2.5 meter or 3.75 meter.

In an aspect of the invention, it relates to a refrigerated merchandising storage unit, a cover of which is mounted using the method according to any of the preceding claims.

THE DRAWING

Figure 1B:
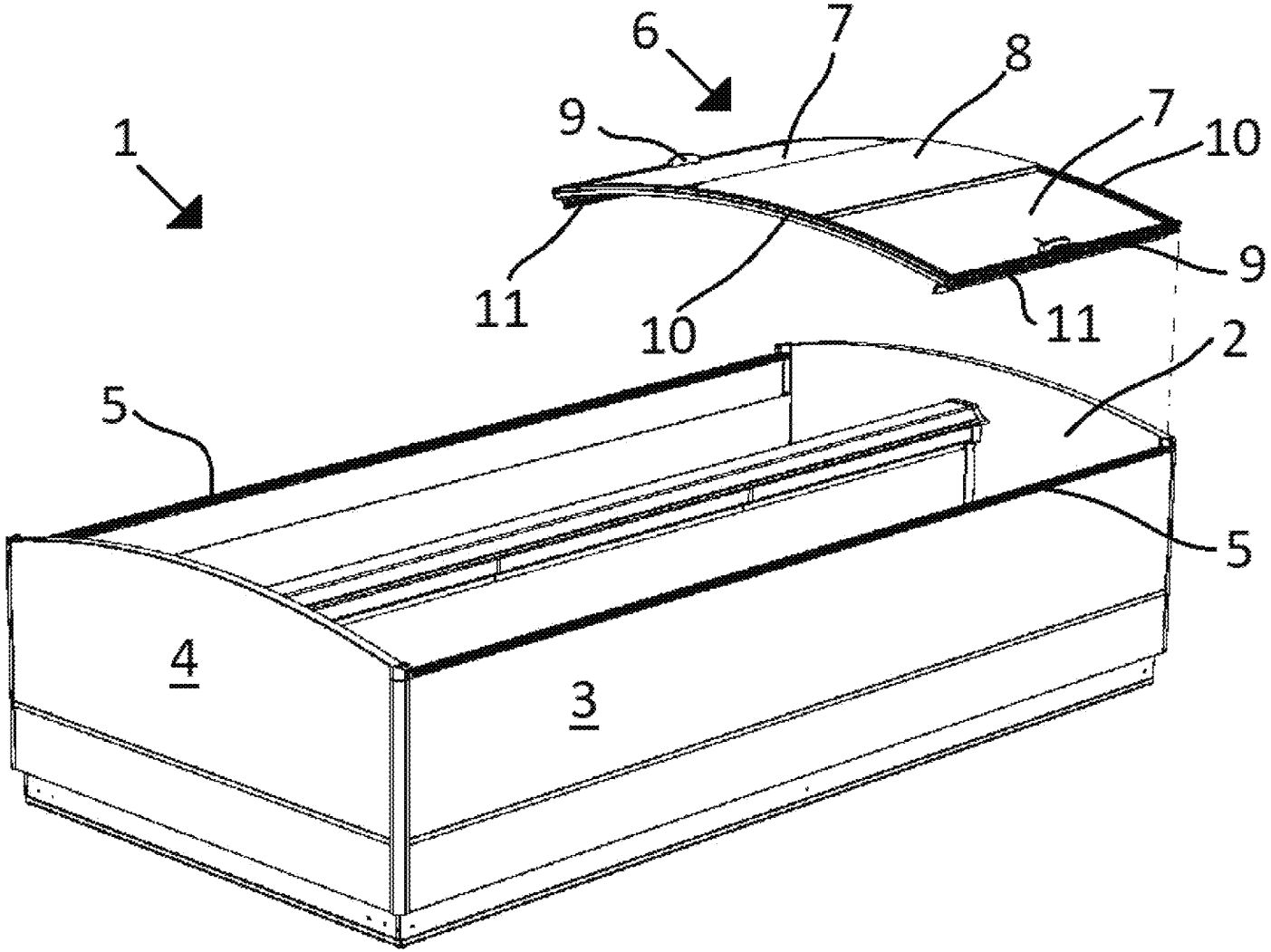
Figure 1C:
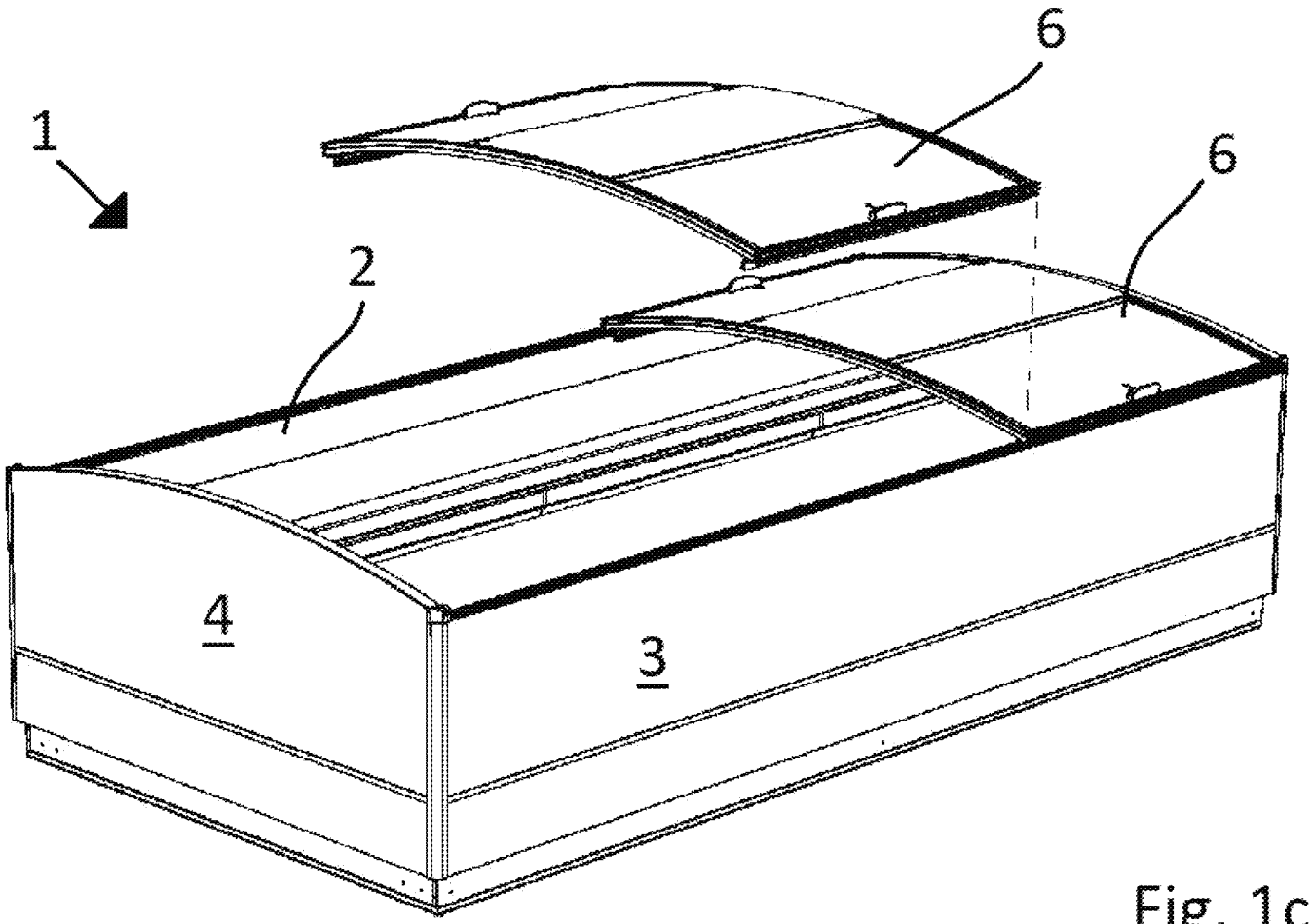
Figure 1D:
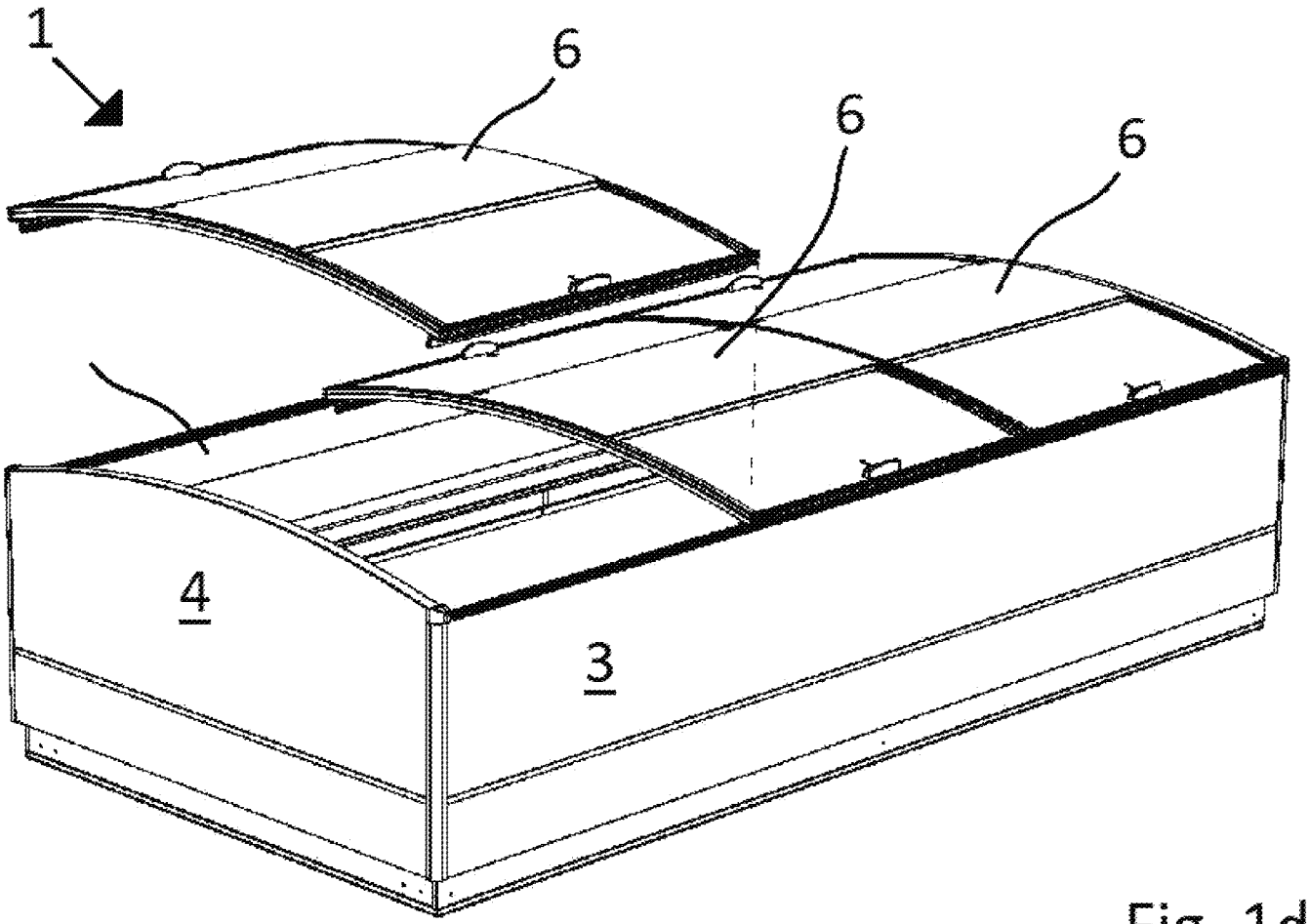
Figure 1E:
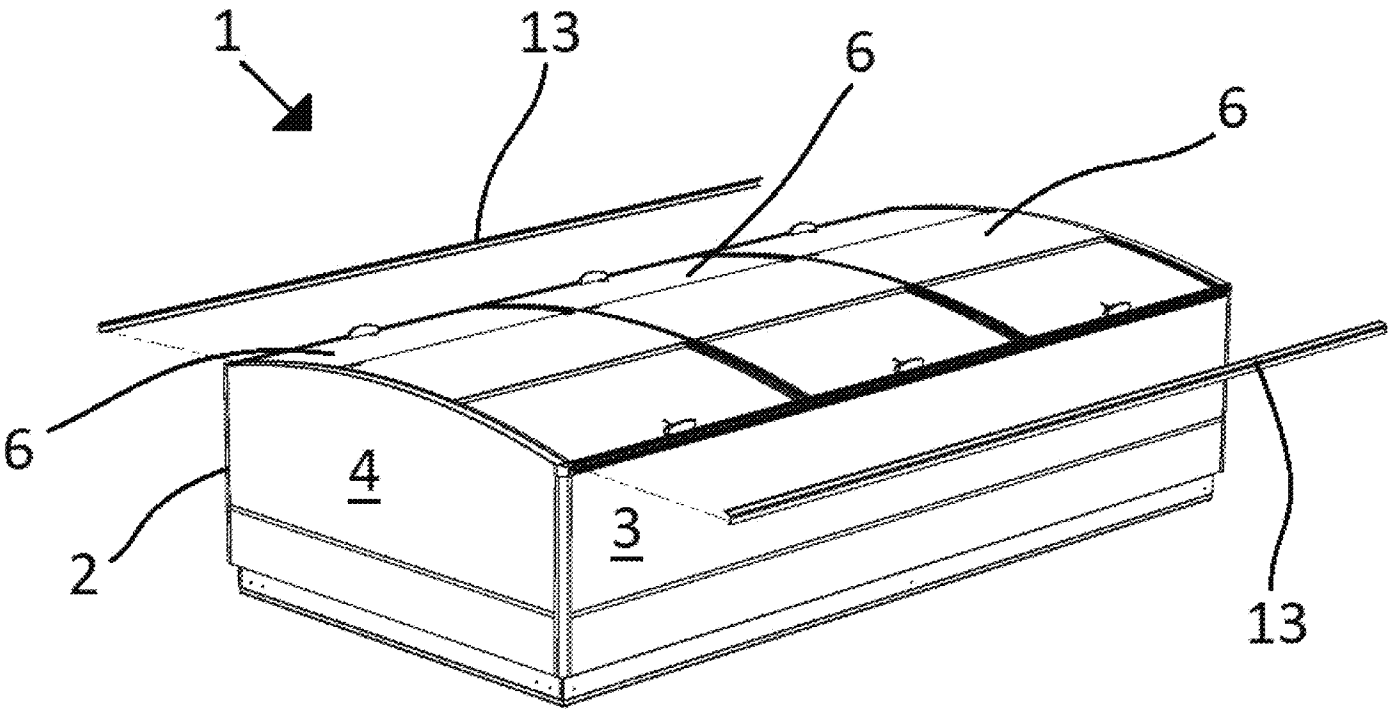
Figure 1F:
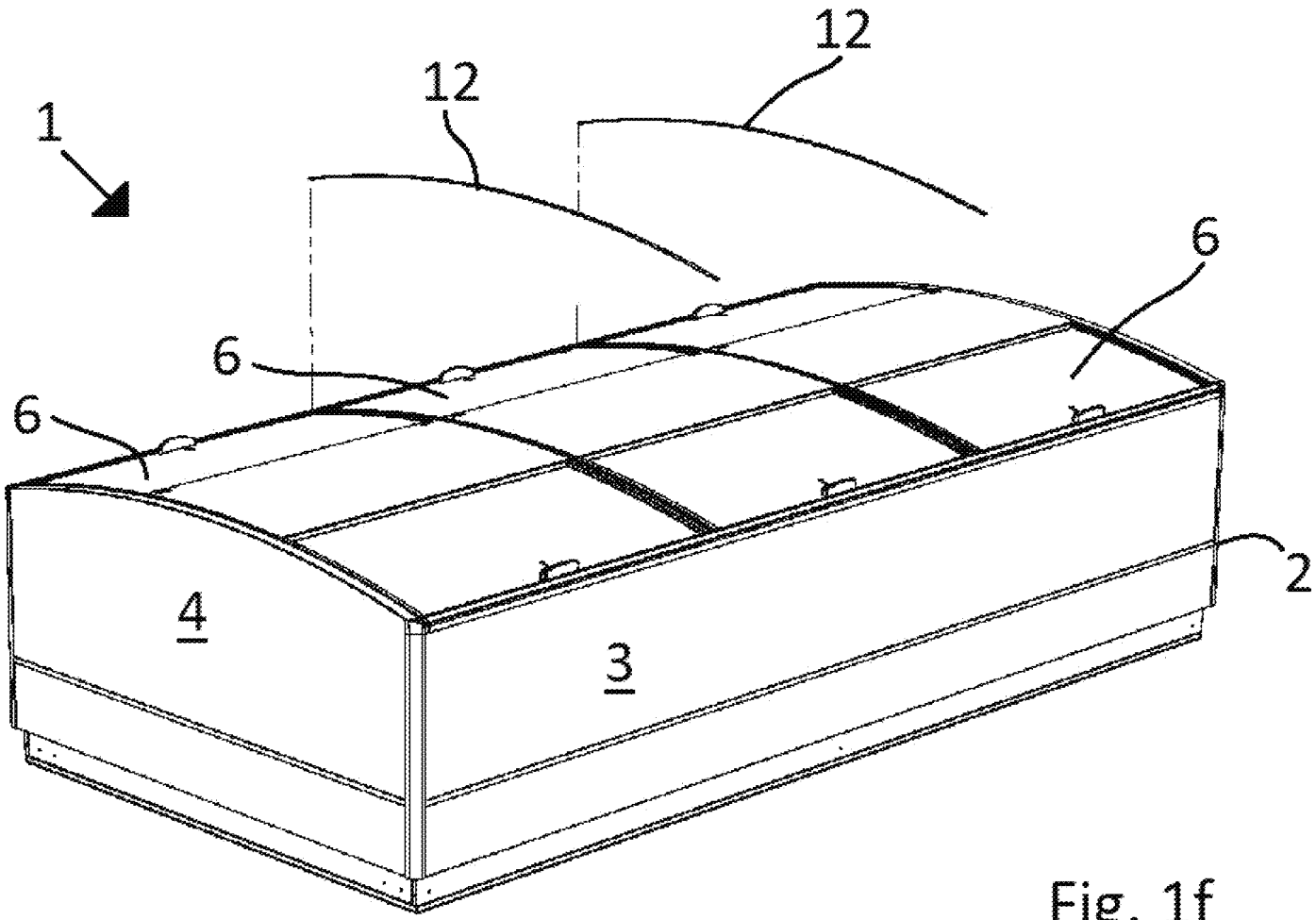
Figure 1G:
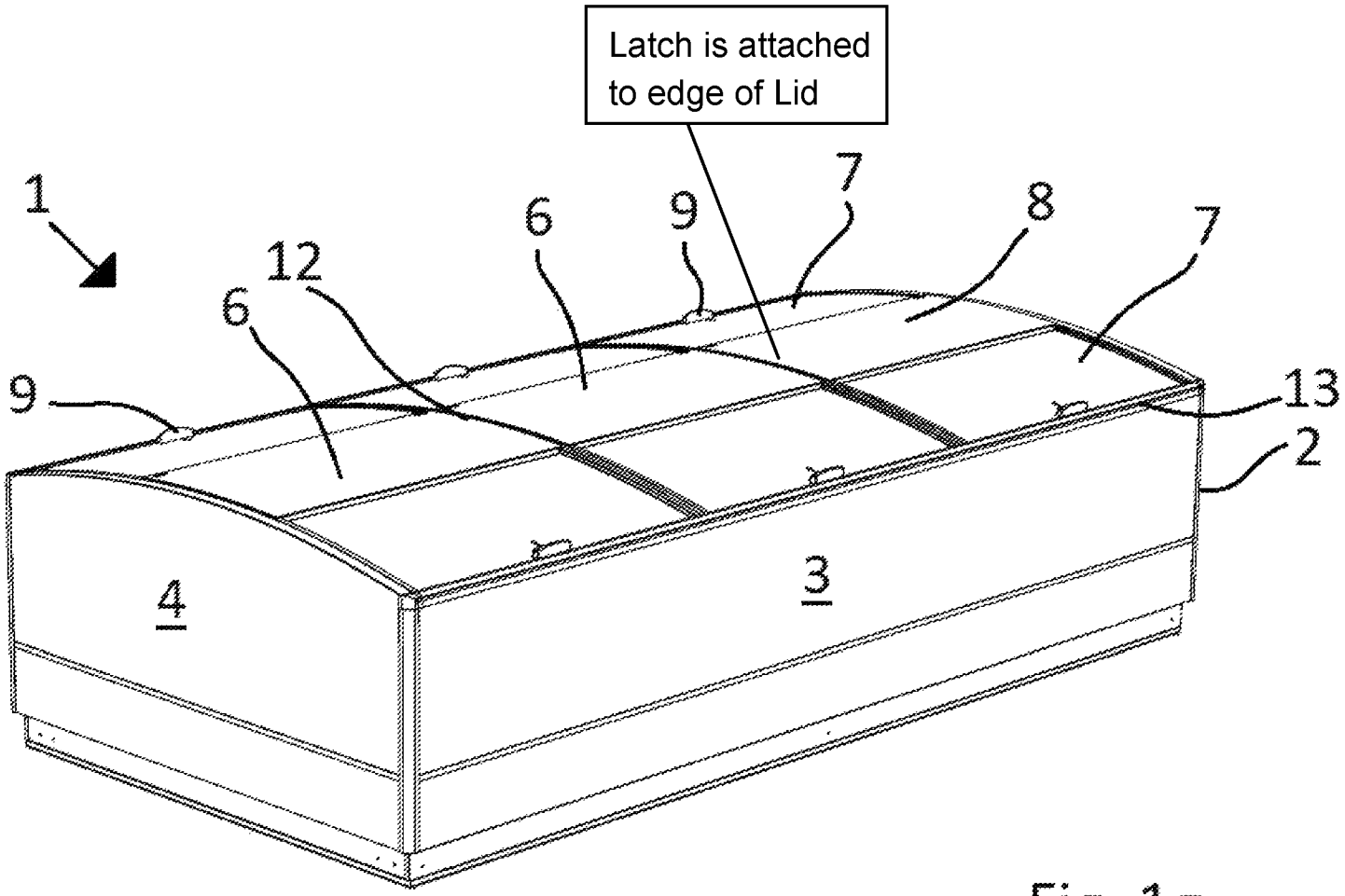
Figure 2:
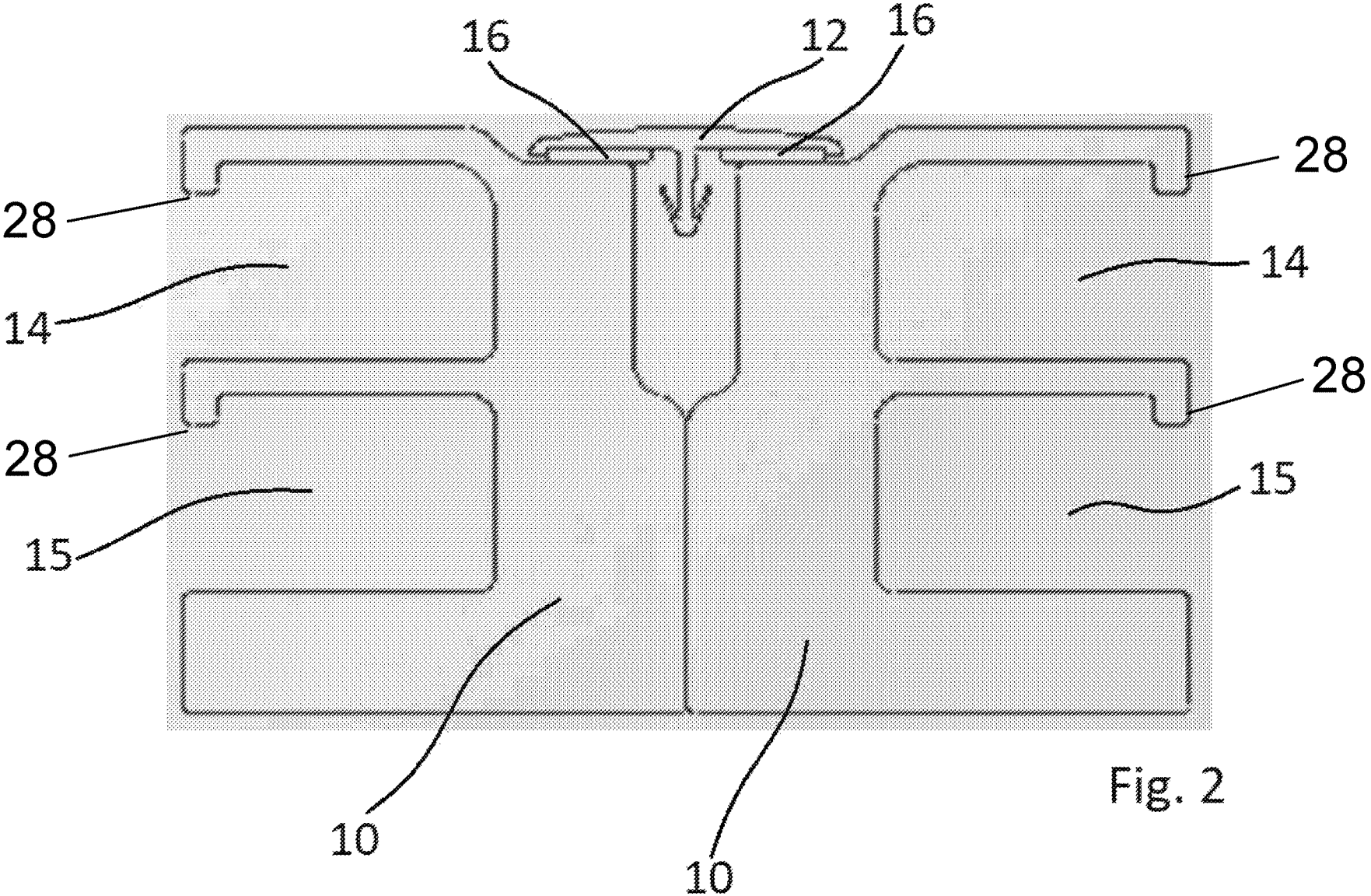
Figure 3A:
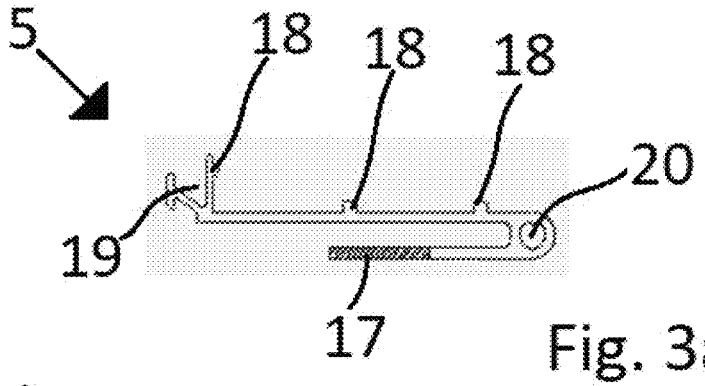
Figure 3B:
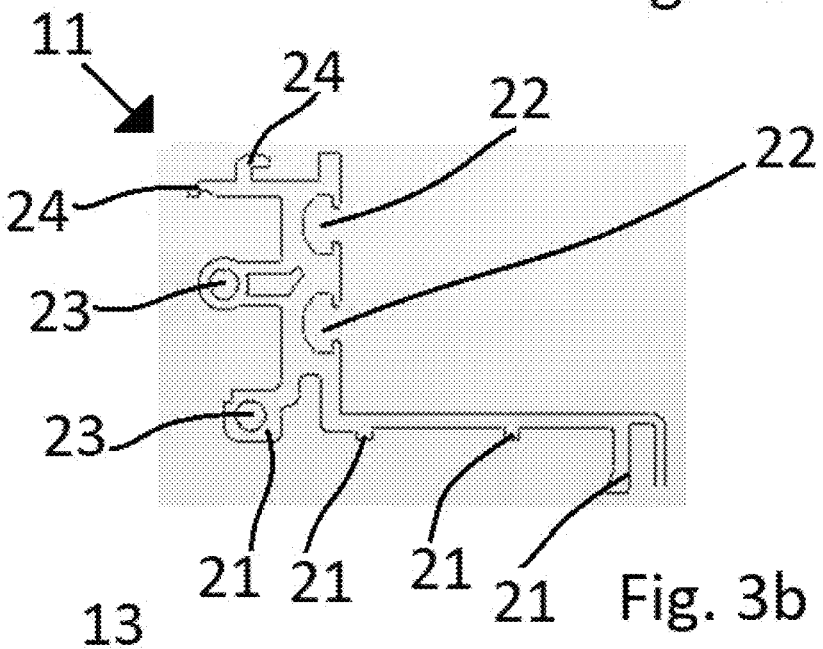
Figure 3C:
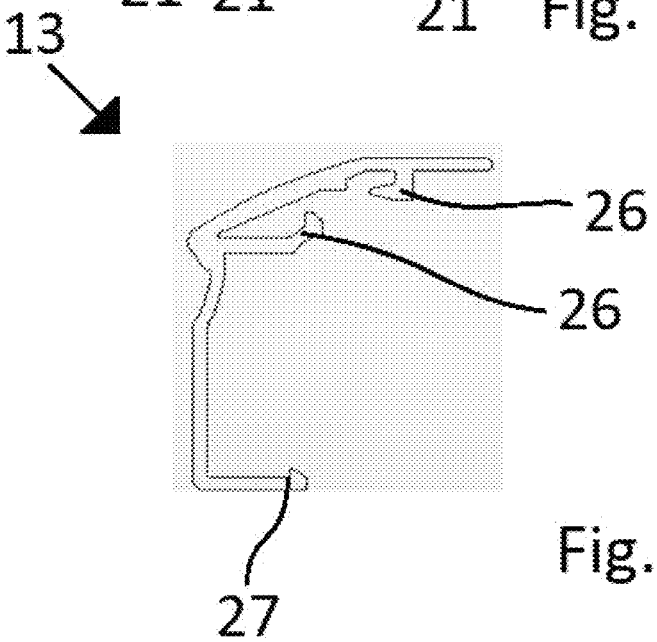
Figure 3D:
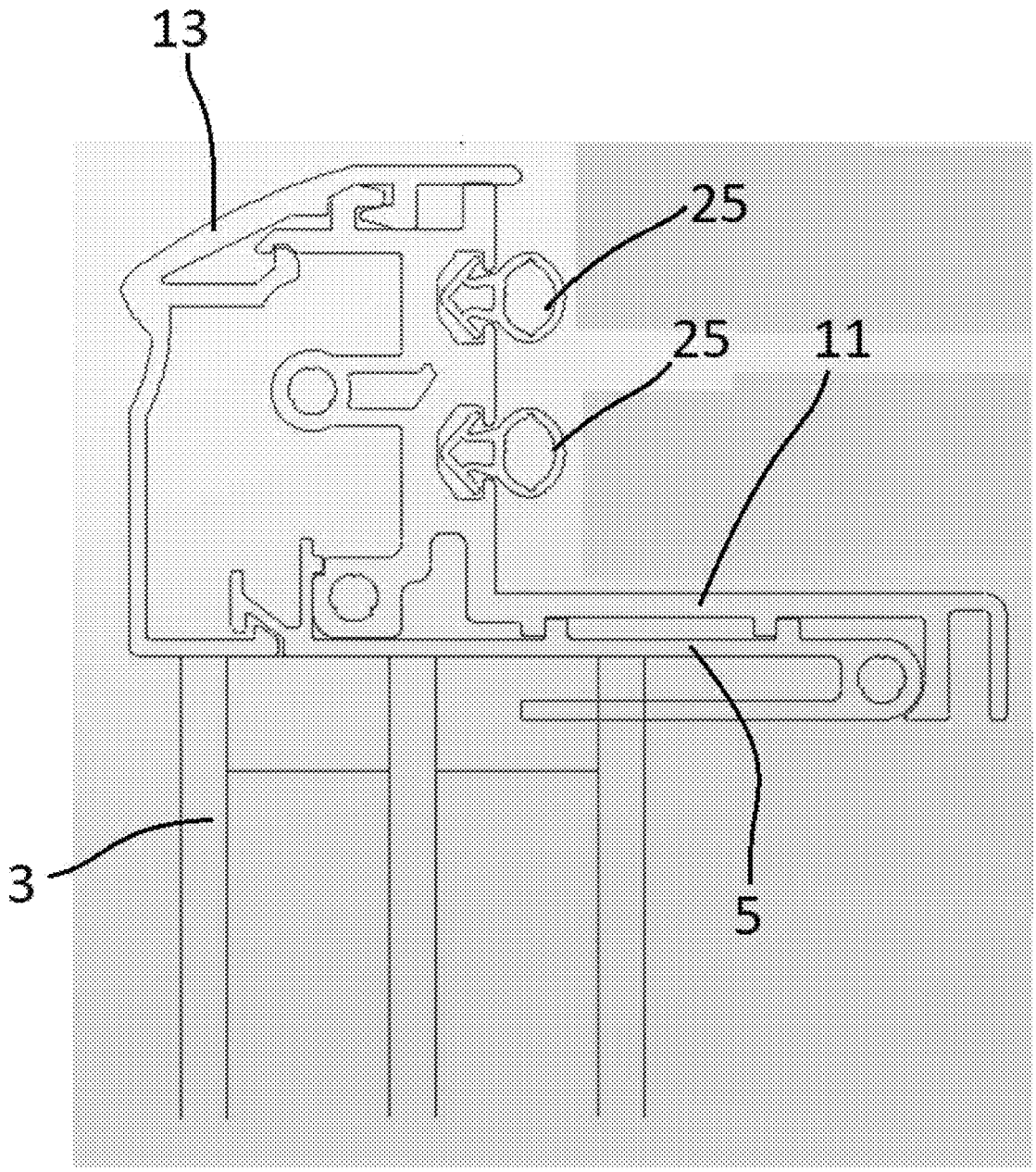

In the following, a few exemplary embodiments of the present invention are described in more detail with reference to the figures of the enclosed drawing, in which:

FIG. 1*a* illustrates a first step of a method for mounting a cover with a plurality of slidable lids onto a refrigerated merchandising storage unit according an embodiment of the invention, FIG. 1*b* illustrates a second step of the same method, FIG. 1*c* illustrates a third step of the same method, FIG. 1*d* illustrates a fourth step of the same method, FIG. 1*e* illustrates a fifth step of the same method, FIG. 1*f* illustrates a sixth step of the same method, FIG. 1*g* illustrates a refrigerated merchandising storage unit obtained by performing the six steps illustrated in FIGS. 1*a*-1*f*, FIG. 2 is a cross-sectional view of the assembly of two cross-profiles of two neighbouring cover cassettes of a refrigerated merchandising storage unit according to an embodiment of the invention, FIG. 3*a* is a cross-sectional view of a spacer profile according to an embodiment of the invention, FIG. 3*b* is a cross-sectional view of a base profile according to an embodiment of the invention, FIG. 3*c* is a cross-sectional view of a cover profile according to an embodiment of the invention, and FIG. 3*d* is a cross-sectional view of a hand-rail assembly according to an embodiment of the invention.

DETAILED DESCRIPTION OF EMBODIMENTS

FIGS. 1*a*-1*f* illustrate a number of steps of a method for mounting a cover with a plurality of slidable lids 7 onto a refrigerated merchandising storage unit 1 according an embodiment of the invention.

In FIG. 1*a*, it is illustrated how a spacer profile 5 is mounted onto the upward-facing edge of each of the two long sides 3 of a storage compartment 2 of a refrigerated merchandising storage unit 1. The spacer profiles 5 are arranged to be able to engage with the base profiles 11 (not shown in FIG. 1*a*) arranged at the ends of the two or more cover cassettes 6 (not shown in FIG. 1*a*) for fastening the cover cassettes 6 are fastened to the storage compartment 2. In the illustrated embodiment, the upward-facing edges of the two short sides 4 of the storage compartment 2 are curved. In other embodiments, they may be straight and horizontal just like the upward-facing edge of each of the two long sides 3.

FIG. 1*b* illustrates how a first cover cassette 6 is mounted onto the storage compartment 2 at one end thereof. In the illustrated embodiment, the cover cassette 6 is assembled with two slidable lids 7 and a fixed lid 8 in a frame comprising two curved cross profiles 10 along the sides thereof and two base profiles 11 along the ends thereof. The fixed lid 8 is arranged on top of the cross profiles 10 at the centre of the cover cassette 6, whereas the two slidable lids 7 are arranged to be able to slide in an upper track 14 and a lower track 15, respectively, arranged along the inner side of each cross profile 10. Thus, by pushing or pulling the lid handle 9 arranged on a slidable lid 7, the slidable lid 7 can be slid away from or towards the edge of the storage compartment 2, respectively, moving under or over the other slidable lid 7 and under the fixed lid 8. In this way, access to the interior of the storage compartment 2 can be obtained and the opening can be closed again. In other embodiments, the cover cassette 6 can comprise other combinations of one or more slidable lids 7 and one or more fixed lids 8.

By mounting two more such cover cassettes 6 like illustrated in FIGS. 1*c* and 1*d*, a full cover for the opening of the storage compartment 2 is obtained by means of the three cover cassettes 6 abutting one another. For each of the cover cassettes 6, the two base profiles 11 engage with the spacer profiles 5 mounted on the edges of the storage compartment 2, for instance through a click-together assembly.

FIG. 1*e* illustrates how a cover profile 13 may be mounted along each long side 3 of the storage compartment 2 for covering the spacer profile 5 and the base profiles 11, thus forming a hand-rail along the edge of the storage compartment 2. The cover profile 13 may engage to the spacer profile 5 and/or the base profiles 11, for instance by a click-together assembly.

Finally, FIG. 1*f* illustrates how a gap profile 12 may be mounted to seal the gap between the abutting cross-profiles 10 of two neighbouring cover cassettes 6 for obtaining a tight cover consisting of the three cover cassettes 6. These gap profiles 12 may, for instance, be mounted using double-sided adhesive tape 16 (see FIG. 2).

FIG. 1*g* illustrates a refrigerated merchandising storage unit 1 obtained by performing the steps illustrated in FIGS. 1*a*-1*f*.

FIG. 2 is a cross-sectional view of the assembly of two cross-profiles 10 of two neighbouring cover cassettes 6 of a refrigerated merchandising storage unit 1 according to an embodiment of the invention assembled as described above. Each of the two cross profiles comprises two longitudinal and generally U-shaped tracks 14, 15, each of which is arranged for receiving an edge of a slidable lid 7 in such a way that the slidable lid 7 can be slid along the longitudinal direction of the track 14, 15, the opposite edge of the slidable lid 7 being received by a corresponding track 14, 15 of the cross profile 10 on the other side of the cover cassette 6 (not shown in this figure). FIG. 2 further illustrates how the gap between the two cross profiles 10 can be sealed by a gap profile 12, which may, for instance, be fastened to the two cross profiles 10 by means of double-sided adhesive tape 16.

FIG. 3*a* is a cross-sectional view of a spacer profile 5 according to an embodiment of the invention, comprising a number of interface features 18 for engagement with a base profile 11 (see FIG. 3*d*). Furthermore, in the illustrated embodiment, the spacer profile 5 is provided with a trimable wall 17, which can be cut for varying thicknesses of the side wall along the long side 3 of the storage compartment 2 (not shown in this figure). An appropriate cutting of this trimable wall 17 determines the correct positions of the base profiles 11 (not shown in this figure) relative to the storage compartment 2. FIG. 3*a* also illustrates how the spacer profile 5 may comprise a channel 19, for instance for a heater cable (not shown), at one end and a channel 20, for instance for a pin (not shown) for alignment of wall sections of the storage compartment 2 (not shown), at the other end. Typically, the spacer profiles 5 are glued onto the edge of the storage compartment 2 (and maybe secured with a few, small self-tapping screws, not shown) allowing for an instant positioning and mounting of the cover cassettes 6 onto the storage compartment 2 of the refrigerated merchandising storage unit 1.

FIG. 3*b* is a cross-sectional view of a base profile 11 according to an embodiment of the invention, comprising a number of interface features 21 for engagement with a spacer profile 5 and a number of interface features 24 for engagement with a cover profile 13 (see FIG. 3*d*). Furthermore, in the illustrated embodiment, the base profile 11 comprises a couple of tracks 22 for bumper sealings 25 (see FIG. 3*d*) and a couple of channels 23, for instance for pins and screws (not shown).

FIG. 3*c* is a cross-sectional view of a cover profile 13 according to an embodiment of the invention, comprising a couple of interface features 26 for engagement with a base profile 11 and a single interface feature 24 for engagement with a spacer profile 5 (see FIG. 3*d*).

FIG. 3*d* is a cross-sectional view of a hand-rail assembly according to an embodiment to of the invention, comprising of a spacer profile 5, one or more base profiles 11 and a cover profile 13, which are clicked together using the interface features 18, 21, 24, 26, 27 designed therefore. The base profile(s) 11 may further be secured to the spacer profile 5 with a few, small self-tapping screws (not shown). A couple of bumper sealings 25 are arranged along the base profile 11 for softening the impact on the base profile 11, when a slidable lid 7 is closed by being drawn towards the base profile 7 until it bumps against it.

It is particularly advantageous that a retainer arrangement is provided near said one or more U-shaped tracks 14, 15 and said one or more lid 7, 8 for retaining the lid in that track, wherein the retainer arrangement comprises a latch fixed to the lid and a protrusion 28 fixed to that track 14, 15, the latch and the protrusion 28 being arranged such that when lateral extraction forces are applied to the lid 7, 8 in a direction away from the track 14, 15, the latch and the protrusion 28 are forced into abutment producing a holding force so that a separation of the lid 7, 8 and the track 14, 15 is prevented, wherein either the protrusion 28 or the latch is made of a resilient flexible, material such that the edge of the lid 7, 8 can be inserted into the track 14, 15, by bending either the latch towards a surface of the lid or the protrusion 28 towards a side of the track 14, 15 on which it protrudes from. Such retainer arrangement is disclosed in international patent application WO 2018/069004 A1.

LIST OF REFERENCE NUMERALS

1. Refrigerated merchandising storage unit
2. Storage compartment
3. Long side of the storage compartment
4. Short side of the storage compartment
5. Spacer profile
6. Cover cassette
7. Slidable lid
8. Fixed lid
9. Lid handle
10. Cross profile
11. Base profile
12. Gap profile
13. Cover profile
14. Upper track
15. Lower track
16. Adhesive tape
17. Trimable wall
18. Interface feature for base profile
19. Channel for heating cable
20. Channel for pin
21. Interface feature for spacer profile
22. Track for bumper sealing
23. Channel for pins and screws
24. Interface for cover profile
25. Bumper sealing
26. Interface feature for base profile
27. Interface feature for spacer profile
28. Protrusion

What is claimed is:

1. A method for mounting a cover with a plurality of slidable lids onto a storage compartment of a refrigerated merchandising storage unit for display and sale of foodstuff or the like, said storage compartment has a substantially rectangular top opening, wherein the method comprises the steps of:

providing two or more cover cassettes, each comprising one or more slidable lids, two cross profiles arranged along two opposite sides of the cover cassette, respectively, and two base profiles arranged along two opposite ends of the cover cassette, respectively, perpendicularly to the cross profiles, each said cross profile or each said base profile comprising one or more elongated and generally U-shaped tracks, each of which is arranged for receiving an edge of one said slidable lid in such a way that the slidable lid can be slid along a longitudinal direction of the track, mounting the two or more cover cassettes on top of the storage compartment in such a way that two opposite ends of each said cover cassette rest upon two upwards-facing edges of the storage compartment, respectively, and in such a way that the two or more cover cassettes together form a cover of the refrigerated merchandising storage unit, and upon mounting of the two or more cover cassettes on top of the storage compartment, mounting along each of the two upwards-facing edges of the storage compartment, onto which the two or more cover cassettes rest, a cover profile, which is arranged to be able to engage releasably with the base profiles of the two or more cover cassettes wherein a protrusion is fixed to said one or more U-shaped tracks and a latch is fixed to said one or more lids for retaining one said lid in one said track, the latch and the protrusion being arranged such that when lateral extraction forces are applied to the lid in a direction away from the track, the latch and the protrusion are forced into abutment producing a holding force so that a separation of the lid and the track is prevented, wherein either the protrusion or the latch is made of a resilient flexible material such that an edge of the lid can be inserted into the track, by bending either the latch towards a surface of the lid or the protrusion towards a side of the track from which the protrusion protrudes.

2. The method according to claim 1 comprising, before the step of mounting the two or more cover cassettes on top of the storage compartment, a step of mounting along each of the two upwards-facing edges of the storage compartment, onto which the two or more cover cassettes are to rest, a spacer profile, which is arranged to be able to engage releasably with the base profiles of the two or more cover cassettes.

3. The method according to claim 2, wherein releasable engagements between the base profiles of the two or more cover cassettes and the spacer profiles and/or the cover profiles are designed as click-together assemblies.

4. The method according to claim 2, wherein the cover profile is arranged to be able to engage releasably with the spacer profiles.

5. The method according to claim 1, wherein the base profiles of the two or more cover cassettes rest upon long sides of the storage compartment.

6. The method according to claim 1, wherein the one or more slidable lids of each said cover cassette are arranged to be slidable in a direction perpendicular to the longitudinal direction of the storage compartment.

7. The method according to claim 6, wherein each of the two or more cover cassettes comprises two said slidable lids being arranged to be slid, one above the other, away from the long sides of the storage compartment, respectively, towards a centre thereof for giving access to an interior thereof.

8. The method according to 8, wherein the cross profiles comprises at least two said generally U-shaped tracks arranged one above the other.

9. The method according to claim 7, wherein each of the two or more cover cassettes further comprises a fixed lid arranged above the two slidable lids in a central part of the cover cassette.

10. The method according to claim 9, wherein the fixed lid is arranged on top of the cross profiles of the cover cassette.

11. The method according to claim 1, wherein the one or more slidable lids of each said cover cassette are arranged to be able to slide in a direction parallel to longitudinal direction of the storage compartment.

12. The method according to claim 1, wherein the two or more cover cassettes and the cross profiles thereof are curved in a direction perpendicular to longitudinal direction of the storage compartment .

13. The method according to claim 1, wherein a dimension in one direction of the two or more cover cassettes is in the range of 0.8 meter to 1.5 meter, in particular 0.94 meter to 1.25 meter.

14. A refrigerated merchandising storage unit, a cover of which is assembled and mounted using the method according to claim 1, the storage unit further comprises a spacer profile mounted onto the upward-facing edge of each of two long sides of the storage compartment of the refrigerated merchandising storage unit, the spacer profiles being arranged to engage with the base profiles and wherein the cover profiles are mounted along each said long side of the storage compartment covering the spacer profiles and the base profiles, thus forming a hand-rail along the long edge of the storage compartment .

15. A method for mounting a cover with a plurality of slidable lids onto a storage compartment of a refrigerated merchandising storage unit for display and sale of foodstuff or the like, said storage compartment has a substantially rectangular top opening, wherein the method comprises the steps of:

providing two or more cover cassettes, each comprising one or more slidable lids, two cross profiles arranged along two opposite sides of the cover cassette, respectively, and two base profiles arranged along two opposite ends of the cover cassette, respectively, perpendicularly to the cross profiles, each said cross profile or each said base profile comprising one or more elongated and generally U-shaped tracks, each of which is arranged for receiving an edge of one said slidable lid in such a way that the slidable lid can be slid along a longitudinal direction of the track, mounting along two upwards-facing edges of the storage compartment, onto which the two or more cover cassettes are to rest, a spacer profile, which is arranged to be able to engage releasably with the base profiles of the two or more cover cassettes, trimming a trimmable wall of the spacer profile for correct positioning of the base profiles, mounting the two or more cover cassettes on top of the storage compartment in such a way that two opposite ends of each said cover cassette rest upon two upwards-facing edges of the storage compartment, respectively, and in such a way that the two or more cover cassettes together form a cover of the refrigerated merchandising storage unit, and upon mounting of the two or more cover cassettes on top of the storage compartment, mounting along each of the two upwards-facing edges of the storage compartment, onto which the two or more cover cassettes rest, a cover profile, which is arranged to be able to engage releasably with the base profiles of the two or more cover cassettes.

* * * * *